US005316409A

United States Patent [19]

Aune

[11] Patent Number: 5,316,409

[45] Date of Patent: May 31, 1994

[54] PORTABLE BOAT SKIDWAY

[76] Inventor: Harold J. Aune, P.O. Box 1141 Stn. E, Victoria, British Columbia, Canada, V8W 2T6

[21] Appl. No.: 743,316

[22] PCT Filed: Dec. 21, 1990

[86] PCT No.: PCT/CA90/00456

§ 371 Date: Oct. 11, 1991

§ 102(e) Date: Oct. 11, 1991

[87] PCT Pub. No.: WO91/09771

PCT Pub. Date: Jul. 11, 1991

Related U.S. Application Data

[63] Continuation-in-part of Ser. No. 454,310, Dec. 22, 1989.

[51] Int. Cl.[5] ..... B63C 3/02

[52] U.S. Cl. ..... 405/1; 405/7

[58] Field of Search ..... 405/1-7; 114/344; 256/57; 403/208, 209, 408.1; 414/537; 193/35 MD

[56] References Cited

U.S. PATENT DOCUMENTS

| | | | |
|---|---|---|---|
| 251,464 | 12/1981 | Rogers | 403/408.1 X |
| 1,418,684 | 6/1922 | Story | 256/57 |
| 2,331,770 | 11/1950 | Ducharme | 405/2 |
| 2,754,017 | 7/1956 | Hart et al. | 405/1 X |
| 3,146,599 | 9/1964 | Young | 405/1 |
| 3,902,588 | 9/1975 | Sato | 193/35 MD X |
| 3,923,150 | 12/1975 | Jager | 193/35 MD X |
| 3,977,030 | 8/1976 | Ringdal | 114/344 X |
| 4,270,581 | 6/1981 | Claxton et al. | 256/57 X |
| 4,507,831 | 4/1985 | McClure | 403/209 X |
| 4,515,198 | 5/1985 | Labonville | 403/209 X |
| 4,824,276 | 4/1989 | Ginell | 403/213 |
| 4,978,272 | 12/1990 | Leon | 193/35 MD X |

FOREIGN PATENT DOCUMENTS

| | | | |
|---|---|---|---|
| 1133652 | 7/1962 | Fed. Rep. of Germany | 405/1 |
| 480348 | 4/1953 | Italy . | |
| 517727 | 7/1976 | U.S.S.R. | 403/208 |

*Primary Examiner*—David H. Corbin

[57] ABSTRACT

A portable boat skidway is provided by combining lengths of steel rods interconnected by flexible joints in a ladder-like array with skidding tubes of high density polymeric material which serve as "rungs". A turning pad is provided by assembling a square of rods with enveloping skidding tubes, and adding a diagonal skidding cylinder.

4 Claims, 3 Drawing Sheets

PORTABLE BOAT SKIDWAY

This application is a continuation-in-part of U.S. Pat. application Ser. No. 454,310 filed Dec. 22, 1989, now abandoned.

FIELD OF THE INVENTION

This invention relates to an articulated skidway for a boat wherein the skidway is both collapsible and readily portable. More specifically, this invention relates to an apparatus that is composed of a number of readily transportable components that may be assembled on a beach or shoreline to provide a skidway by which a boat may be launched or drawn-up out of the water.

BACKGROUND TO THE INVENTION

The need to provide lightweight skidways for small craft to permit them to be launched or drawn-up on a shoreline has previously been recognized. Examples of prior art patents addressing this objective are:

U.S. Pat. No. 3,579,996—Jerry W. Edson
U.S. Pat. No. 3,587,874—Edwin H. Graf
U.S. Pat. No. 4,803,942—Joseph Dren
U.K. 2,116,123—William G. Watson.

None of these references provide for an articulated slipway, of extended length, that is readily portable.

Three patents that do propose structures that provide an articulated slipway are:

U.S. Pat. No. 4,290,728 to Lucien Leduc
U.S. Pat. No. 2,754,017 to H.E. Hart et al
Italy 480,348 to Giacomo Ghiglione.

In the Leduc patent a series of transverse bars are linked together by chains in a ladder-like manner. These chain-linked bars are supported between longitudinal stringers to provide a support base for planks used to create a ramp up into the back of a vehicle. However, the chains do not resist collapsing, and it is not readily apparent how this system could be deployed on a beach as a non-collapsible skidway.

In the Hart patent a series of racks bearing rollers are deployed progressively up the side of a beach. The rollers within each rack are rigidly mounted in a rocking frame. The sides of each frame are considerably longer than the width of the rollers, and these individual frames are not readily disassemblable. This system is complex and has according, a considerable cost penalty.

The patent to Ghiglione shows a series of transverse slider bars, depicted as being made of wood, held together in an articulated ladder-like array by a series of rods that interconnect joints mounted at the end of each bar or "rung". The specific structure of Ghiglione relies upon an upper wooden rung upon which the keel of a boat may be slid. This rung is fastened from below to a metal bar that is up-turned at its outside ends to provide a mount for a pin (4) to which inter-rung connecting rods are attached. Thus the connections between the rods and rungs in Ghiglione are not articulated in the lateral direction, and the Ghiglione skidway can not be swerved sideways in a staggered fashion. Further Ghiglione does not use a tubular skidding cylinder which may be rotated to distribute wear.

The articulated detachable structures described are articulated only to be extent that they are flexible in a single transverse or rotational direction. In Leduc the transverse bars are confined laterally by the longitudinal stringers. In Hart, each rack of rollers may be tipped about only one axis. And in Ghiglione, the connecting rods are attached to pins which serve as shafts and limit flexibility to rotation about the axis of such shafts.

None of these references provide a skidway which has the feature of being fully articulated in the sense of being fully articulated, that is to say of being flexible both laterally, in the plane of the skidway, and perpendicularly to the plane of the skidway.

A further need for small boat owners is to provide a turning pad by which boats may be re-oriented, once pulled up onto the beach.

Boats are normally landed bow first when landing on a beach. There is a need for a system by which a boat can be hauled up the track, centered over a pivoting device and turned around to enable a bow-first launch. This is very advantageous for a number of reasons:

Small outboard powered planing hulls have a weight concentration in the stern often combined with a sharp, squared off transom. They will potentially "hang up" on a skidway when skidded along stern first. A turning pad enables boats to be turned 180 degrees and skidded bow first.

A bow-first launch is advantageous when launching into wave conditions.

Furthermore the turning pad enables boats to be handled by a single person or at least fewer people by enabling them to be skidded bow first.

With this background in mind, the invention in its general form will first be described, and then its implementation in terms of specific embodiments will be detailed with reference to the drawings following hereafter. These embodiments are intended to demonstrate the principle of the invention, and the manner of its implementation. The invention will then be further described, and defined, in each of the individual claims which conclude this Specification.

SUMMARY OF THE INVENTION

According to the invention an articulated skidway is provided by a series of connecting rods, each joined at its respective ends to the ends of two other rods by fully articulated detachable coupling means to thereby form an articulated ladder-like formation that is laterally flexible both in the plane of said formation and perpendicularly to such plane, there being provided around each rod which serves as a rung within such formation, a tubular skidding cylinder.

As a preferred configuration for the invention a series of modular segments of connecting rods are provided, each module comprising a bundle of three rods commonly joined at each of their first ends by an articulatable coupling and being provided at their respective second, free ends with coupling means by which each of said second ends may be joined, in an articulated fashion, with the second ends of two other connecting rods originating from two other modular segments of rod bundles. The modular segments of connecting rods are capable of being laid-out in a ladder-like formation with the rods in each segment forming a "T" shape wherein the second free end of one rod of each bundle is connected to the second ends of the rods of two other modular segments to provide a rung. The skidway is completed by providing on the rod which serves as a rung, a tubular skidding cylinder adapted to minimize the resistance to a boat being slid thereover.

Optionally, the skidway may be provided at either or both of its ends with anchor means by which the ends of the skidway may be fastened to the underlying earth.

By a preferred feature of the invention, the skidding cylinder is circular in cross-section and is provided with at least two symmetrically disposed, disc-shaped flanges adapted to maintain a boat generally centered on the skidway. Such flanges are preferably mounted inwardly from the ends of the skidding cylinders and may be symmetrically disposed about the centers of the cylinders.

By a further feature of the invention, the rods of each modular segments are joined at their first ends by providing one rod with an off-centered looped end that forms an off-centered eye, and providing the first ends of the other two rods with looped ends forming eyes that are interlocked with the off-centered eye so as to permit the three rods to nest in substantially parallel alignment with each other.

By a further feature of the invention the second, free ends of the rods in each modular bundle are dimensioned to be joined to the free ends of rods from other bundles by having a shackle passed through an eye formed by a loop bent into the second ends of each of said rods.

By a further alternate feature of the invention, at least two of said second ends of the rods in each modular segment are provided with substantially closed eyes bent therein, and the second end of a third rod is provided with a resiliently openable eye formed by terminating said second end of said third rod with a loop that has an extension portion adapted to permit said resiliently openable eye to be elastically levered open to receive said closed eyes. Optionally said substantially closed eyes may also be resiliently openable.

This invention provides a skidway system that supplied as a "kit" and can be installed or removed easily and quickly with no special mechanical aptitude or previous experience. For example a 24 foot section can be installed by the average person in ½ hour with no previous experience. It can be extended to any length. It can be utilized on most surfaces including concrete, rock, cobble stone, gravel, shale, clay, sand, or mud. Constructed of suitable materials it will withstand corrosive conditions well, as well as wear and tear from the elements.

By reason of the compact nature of the individual components, this product is small enough when dismantled and packed so as to be easily stored in a small space e.g. boat locker, car trunk etc. It is light enough to be easily handled by any average person.

The frictional resistance to propelling a boat or object along the track is minimal, with the use of skidding cylinders composed of high density, polyethylene plastic tubing. This type of plastic also has the property of not being brittle in freezing conditions and is highly resistant to damage by ultra violet rays.

The skidding cylinder is preferably of a larger inside diameter than the rods, thus having a "sloppy" fit. This ensures that the skid is free to pivot around the rung member of the ladder-like track and ensures longevity by presenting more wear surface through random or intentional rotational repositioning of the cylinder.

The use of flanges is incorporated into the skids to provide directional control and maintain alignment of the object or boat being slid along the track. Such flanges are principally located inwardly from the ends of the skidding cylinders. Two pairs of flanges may also be employed on a cylinder, respectively with pairs located both on the outside ends of the skidding cylinders and inwardly from the ends, but removed from the center.

The invention of using plastic skidding tubes located by ridged rods may be adapted to provide a "turning pad", allowing boats to be re-oriented once pulled up onto the beach.

An array of four skidding cylinders may be assembled using flexibly-linked connecting rods which are assembled into a square pattern. Each of the four rods which serve as one side the square carries an enveloping skidding tube. The rods are flexibly joined at their ends. Because the rods are incompressible, the tubes are held in an array which can distort into an even-sided trapezoid which will resist collapsing.

A further skidding cylinder is located diagonally within the square, supported buy a further connecting rod or a chain. Chains may be used because the other rods render the square resistant to collapsing.

When a boat's hull is positioned with this array under its weight center, minimal effort is required to skid it around 180 degrees. The fifth cylinder prevents the boat hull from dropping into the center space between the side cylinders.

The foregoing summarizes the principal features of the invention. The invention may be further understood by the description of the preferred embodiments, in conjunction with the drawings, which now follow.

DESCRIPTION OF PREFERRED EMBODIMENTS

Figure 1:
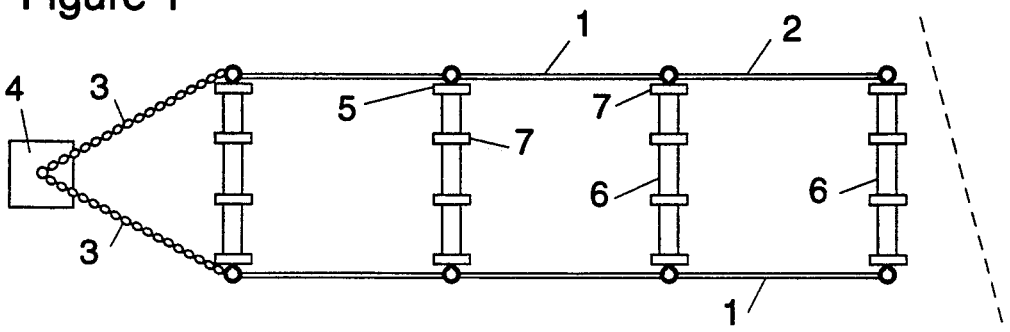
FIG. 1 is a plan view of the skidway, as assembled.

In FIG. 1 a series of outer connecting rods 1 define the sides of the skidway 2. At one end chain 3 extends from the connecting rods 1 to an anchor plate 4 which may be buried in the earth.

Transverse rods 5 carry skidding cylinders 6. To guide and center a boat on the skidway, disc-like flanges 7 are formed on the outside ends of the cylinders 6, and inwardly from such ends in symmetrical pairs.

Figure 2:
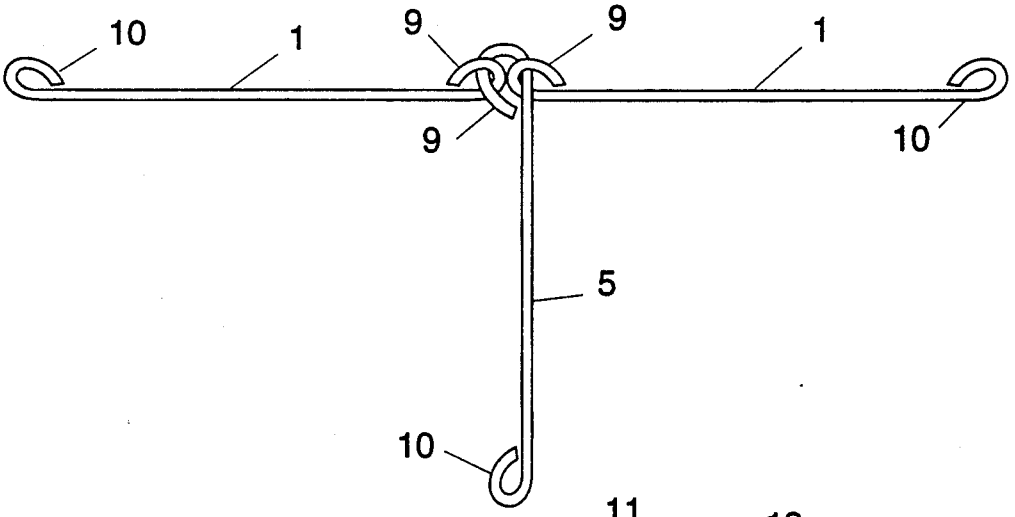
FIG. 2 is a depiction of a three rod bundle that forms one modular segment.

In FIG. 2 a basic module of three rods 1,1,5 is shown, deployed in a "T" shaped configuration. These are joined at their intersecting ends by inter-engagement of eyes 9 formed on the rod ends. The free or second ends of each of the rods 1,1,5 are also provided with outer eyes 10 bent into the free ends of the rods as loops.

Figure 3:
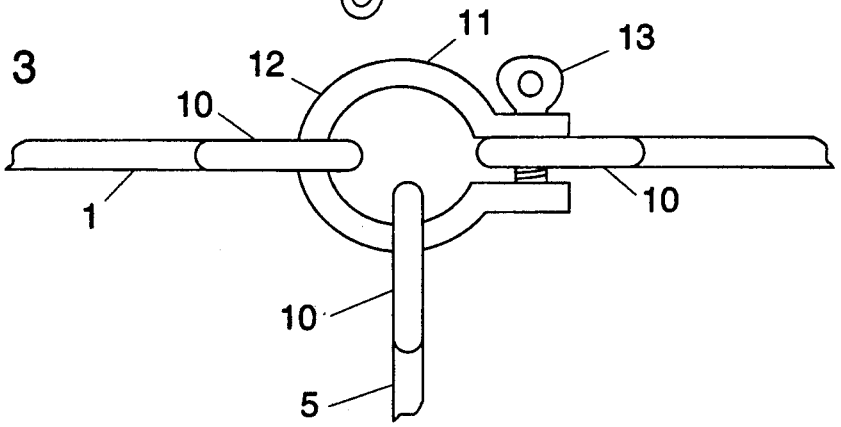
FIG. 3 shows the free ends of three rods joined by a shackle.

In FIG. 3, three closed outer, free eyes 10 are shown connected by a standard shackle 11 having a horseshoe hooped portion 12 and a threaded locking pin 13.

This is but one optional means for joining the free ends 10 of the rods 1,5. Alternate means would include bolts or the resilient loop arrangement shown below.

Figure 4:
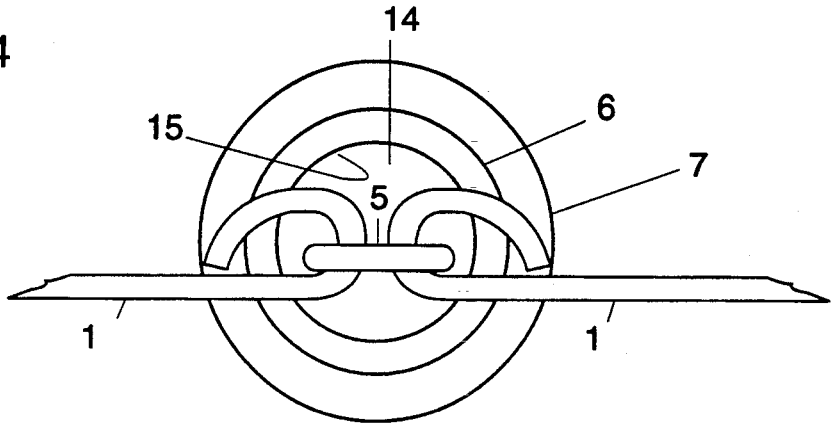
FIG. 4 shows an end view of three rod ends, permanently coupled, with a skidding cylinder in place over one rod.

FIG. 4 is an end view of one of the skidding cylinders 6. This cylinder 67 has an outer disc-shaped flange 7 integrally fastened to its outer surfaces. The transverse rod or rung 5 passes into the interior core 14 of the cylinder 6. This core has an interior cylindrical surface 15 of considerably greater diameter than that of the transverse connecting rod 5. Thus, there is a sloppy fit between the rod 5 and cylinder 6. This feature accommodates flexure of the transverse rod 5 and allows the cylinder 6 to have an outside surface of greater area.

Figure 5A:
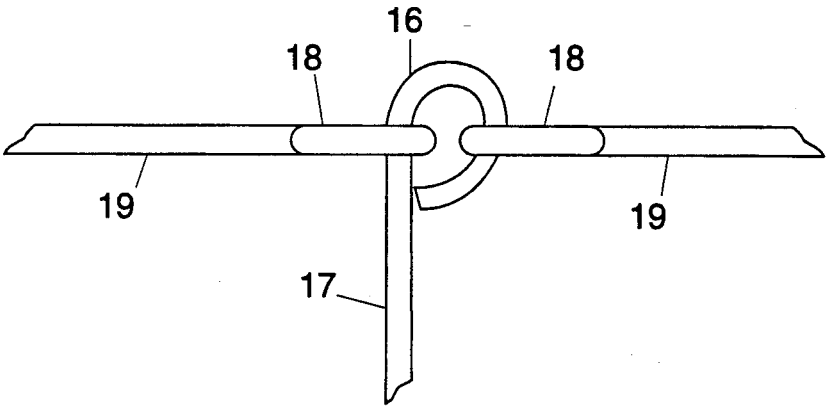
FIGS. 5*a* and 5*b* show the coupled ends of the rods connected in a manner that allows them to be nested when the skidway is disassembled.
Figure 5B:
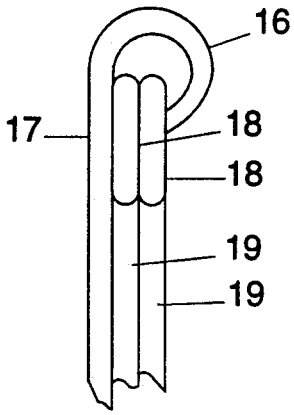

In FIG. 5*a* a loop 16 is bent into one rod 17 in an offset manner. The ends 18 of two other rods 19 are engaged by the offset loop 16. This arrangement allows the rods to nest parallel for storage, as shown in FIG. 5*b*.

Figure 6:
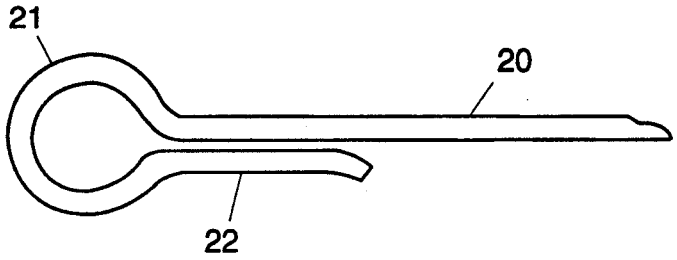
FIG. 6 shows a rod end with a resiliently openable loop provided with an access lever arm.

FIG. 6 shows an alternate means for forming a removable coupling on the end of a rod. The rod 20 has a loop 21 formed therein that terminates in an extended lever arm 22. The metal of the loop is selected to be elastically resilient. A rod end of this form may be coupled to an eye or loop on another rod end by simply spreading the lever arm 22 to hook the eye ends together, and then allowing the resilient loop 21 to close-up again.

The rods described herein may be made preferably of mild steel. To resist corrosion, they should be galvanized, or alternately made of stainless steel. Preferred diameters are 3/16 inches to ⅜ inches, as a compromise between weight and strength. The "rung" spacing may conveniently be on the order of 32 inches.

Chain for the anchor may be commonly of ¼ inch size, but ranging 3/16 to ½ inch. The anchor plate may be about 9 inches square, a size which allows sufficient earth to be piled on top to render it relatively immobile. Either or both ends of the skidway may be anchored.

The skidding cylinder may be composed of standard high density polyethylene pipe. This material is intrinsically slippery. As pipe, it will tend to act as a roller but will be restrained by the ladder-like formation of rods. If this cylinder is made of low friction material, however, it is not essential that it rotate and no provision is made for a journal or bearing to facilitate rotation.

Figure 7:
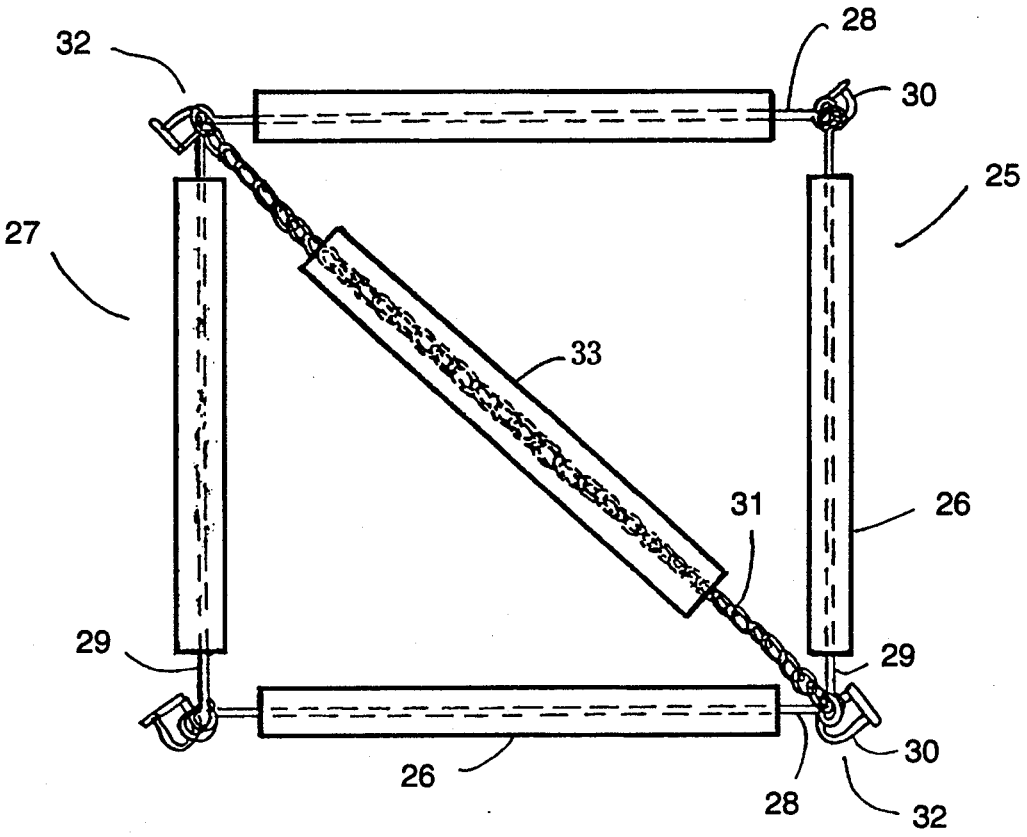
FIG. 7 shows a turning pad assembled using the components of the invention.

In FIG. 7 a turning pad 25 is shown composed of four skidding cylinders 26 that are linked together by the opposed pair of connecting rods 28 that serve as rungs and the opposed pair of outer rods 29 that join such rungs. The connecting means 30 joining the ends of the rods 28, 29 are articulated in a manner that would allow the square-like array 27 to be skewed into a trapazoidal form. However, a diagonal link 31, which may be a rod or chain, joins one pair of opposed corners 32. This diagonal link 31 also carries a diagonally placed skidding cylinder 33.

So assembled, a boat may be pulled onto the turning pad 25 and then rotated with minimal effort. Like the skidway, the turning pad 25 so described, is dismantlable and readily transportable for re-assembly.

This turning pad 25 may conveniently be formed at the end of a skidway of the type previously described; or it may be free-standing as a separate convenient device for turning boats.

The foregoing disclosure therefore shows how an articulated slipway and turning pad of low cost may be formed from lightweight components, that may be easily stored and transported, and which will provide satisfactory service for lightweight boats and the like when assembled. The invention in its broadest aspect, and in its more particular details, is further described and defined in the claims which now follow.

The embodiments of the invention in which an exclusive property or privilege is claimed are defined as follows:

1. An articulated skidway for boats and the like comprising a series of connecting rods, each joined at its respective ends to the ends of two other rods by flexible coupling means in a ladder-like formation, there being provided around each rod which serves as a rung within such formation a tubular skidding cylinder wherein:

(1) said cylinder is circular in cross-section and is provided with at least two encircling flanges respectively disposed on both sides of the central, midway portion of the length of said cylinder, inwardly from the ends thereof, at positions whereby said flanges will serve to maintain a boat generally centered on the skidway; and (2) such cylinder has an interior cylindrical diameter that is considerably greater than that of the connecting rod to provide a sloppy fit between the rod and cylinder for rotation there-between without a bearing being therein provided, whereby said cylinder may be rotationally repositioned to distribute wear over its surface.

2. A skidway as in claim 1 comprising:

(1) a turning pad wherein at least one pair of outer opposed connecting rods joining the rods that serve as rungs and form a square or trapazoidal array are provided with a pair of tubular enveloping skidding cylinders; and (2) a further skidding cylinder, diagonally positioned between opposed corners formed by the coupled connecting rods.

3. A kit for assembling an articulated skidway for boats and the like comprising:

(1) a series of modular segments of connection rods, each of said modular segments comprising a bundle of three rods, each of said rods within each of said segments being commonly joined at each of their first ends by a first flexible coupling means;

(2) second coupling means by which the second ends of each of said rods may be joined, in a flexible fashion, with the second ends of two other connecting rods originating from two other modular segments of connecting rods, said modular segments being connectable to provide a ladder-like formation, with the rods in each segment deployed in a "T" shape wherein the second end of one rod of each modular segment is connected to the second ends of two rods of two other modular segments to provide a rung for said ladder-like formation; and tubular skidding cylinders wherein each of such cylinders:

(3) is dimensioned to fit over each rod which serves as a rung, and provide a surface upon which boats may be slid;

(4) is circular in cross-section and is provided with at least two encircling flanges symmetrically disposed on both sides of the central, midway portion of the length of said cylinder, inwardly from the ends thereof, at positions whereby said flanges will serve to maintain a boat generally centered on the skidway; and (5) has an interior cylindrical diameter that is considerably greater than that of the connection rod serving as a rung to provide a sloppy fit between the rod and cylinder for rotation there-between without a bearing being provided therein, whereby said cylinder 4. A kit as in claim 3 wherein, one of the rods of each said modular segment is provided with an off-centered looped end, displaced to one side of the longitudinal axis of said rod, forming an off-centered eye, the first ends of the other two rods of each modular segment being provided with looped ends forming eyes that are interlocked with the off-centered eye so as to permit the three rods to nest in substantially parallel alignment with each other.

* * * * *